US007661308B2

(12) United States Patent
Eggleston

(10) Patent No.: US 7,661,308 B2
(45) Date of Patent: Feb. 16, 2010

(54) APPARATUS AND METHOD FOR DETERMINING THE DEPTH LEVEL AND AMOUNT OF FLUIDS IN A WELL

(76) Inventor: Phil Eggleston, 5009 Marshall Dr., Sherman, TX (US) 75090

( * ) Notice: Subject to any disclaimer, the term of this patent is extended or adjusted under 35 U.S.C. 154(b) by 425 days.

(21) Appl. No.: 11/545,853

(22) Filed: Oct. 12, 2006

(65) Prior Publication Data

US 2008/0088465 A1 Apr. 17, 2008

(51) Int. Cl.
*G01F 23/30* (2006.01)
*G01B 5/18* (2006.01)

(52) U.S. Cl. ..... 73/308; 33/715; 33/716; 33/719

(58) Field of Classification Search ..... 340/623, 340/624; 73/305, 308; 116/228, 110
See application file for complete search history.

(56) References Cited

U.S. PATENT DOCUMENTS 1,695,701 A * 12/1928 Steiner et al. ..... 33/716
2,139,810 A * 12/1938 Duncan ..... 33/716
2,190,260 A * 2/1940 Ennis ..... 374/136
3,075,466 A 1/1963 Agnew et al.
3,882,665 A * 5/1975 Hughes et al. ..... 57/217
3,998,568 A 12/1976 Hynd
4,583,916 A 4/1986 Senghaas
5,448,477 A * 9/1995 Delatorre et al. ..... 702/6
6,464,012 B1 10/2002 Strickland
7,007,751 B2 3/2006 Eggleston
7,318,446 B1 * 1/2008 Tarver ..... 137/382

* cited by examiner

*Primary Examiner*—Hezron Williams
*Assistant Examiner*—Nathaniel Kolb

(57) ABSTRACT

An apparatus and related method for detecting oil and mineralized water, if it exists, in a well. The apparatus comprises a sensor assembly for placing down the well, the sensor assembly having a float therein that rises when fluid is detected and adapted to close an electrical contact of a circuit having a power source. The apparatus also has a base assembly used for raising and lowering the sensor assembly into and out of the well. An alarm is electrically coupled to the circuit that includes the sensor assembly and power source, the alarm operable to indicate when the electrical contact is closed.

11 Claims, 5 Drawing Sheets

APPARATUS AND METHOD FOR DETERMINING THE DEPTH LEVEL AND AMOUNT OF FLUIDS IN A WELL

TECHNICAL FIELD

The present invention relates to apparatus and methods used in the recovery of oil in oil producing fields.

BACKGROUND

Stripper wells are oil or gas wells that are either non-producing or yield very little oil, generally less than three barrels a day. Because of their low yield, these wells are often abandoned due to the cost to recover the oil. Over time, however, these wells often can recover so that, often for a limited time, oil can be once again be extracted from the well. Many times these wells are often sold or leased in hopes of recovering oil that may have accumulated in the wells. Several techniques have been developed for extracting oil in these wells. They include placing pump jacks having timers set to operate the pump at known oil recovery intervals. Conventional recovery devices include bailers and air jets techniques. Each of these techniques has the disadvantage that each is unable to determine the depth at which oil resides in the well, and the amount of recoverable oil in the well.

Before these recovery techniques are used it would be advantageous to determine the depth at which oil can be found in the well, and if there is mineralized water present, at what depth such mineralized water exists. This information could be used to determine how much oil is available to recover and to evaluate whether it is worth recovering.

SUMMARY OF THE INVENTION

The present invention comprises an apparatus and method for determining the amount of fluids, such as oil and mineralized water, in a well by determining the depth where the top of the fluid in the well resides and the depth where the oil sits on top of mineralized water, if it is present in the well.

DESCRIPTION OF THE FIGURES

The foregoing and other objects and advantages of the invention will become clearer with reference to the following detailed description as illustrated by the drawings in which.

DETAILED DESCRIPTION

The device and method described below enables the user to determine the amount of oil in a well, even when mineralized water is present. It does so by determining the top of the oil column in the well, and the level of mineralized water, if it is present. Once this is known, the amount of oil in the well can be easily calculated. Knowing how much oil is present in the well greatly aids in the cost calculations to determine whether the cost to recover the oil is feasible.

Figure 1:
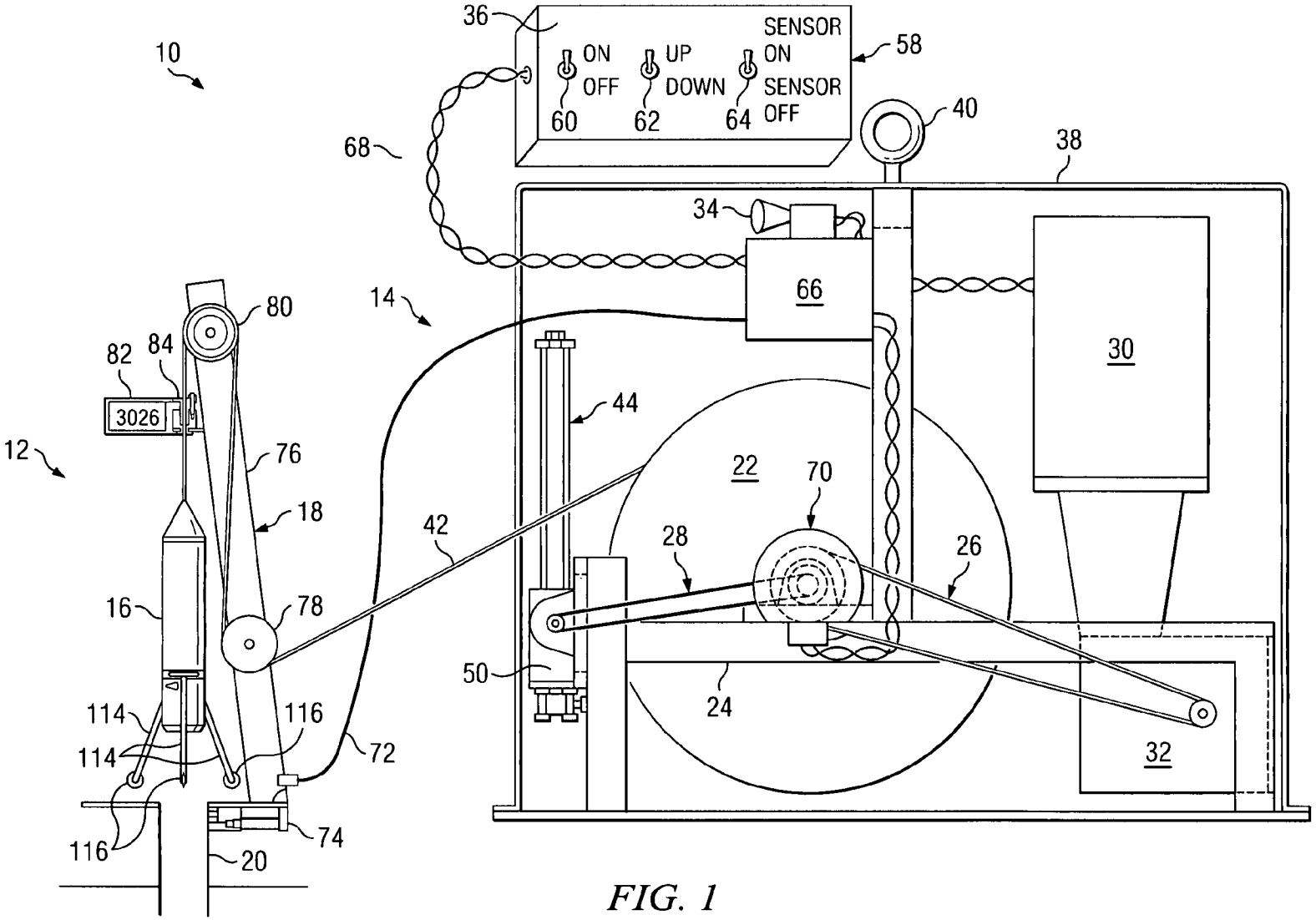
FIG. 1 is a first view of the apparatus of the present invention comprising a sensor assembly and a base assembly used to detect oil and/or mineralized water in a well.

Referring now to FIG. 1, an interface tool 10 used to determine the oil and mineralized water levels in the well is illustrated. Generally this tool includes two components, an interface sensor assembly 12 and a base assembly 14. The interface sensor assembly 12, which will be discussed in greater detail below with reference to FIG. 3, consists of a sensor assembly 16 and a sensor stand 18 used to guide the sensor assembly 16 into and out of a well 20.

Figure 2:
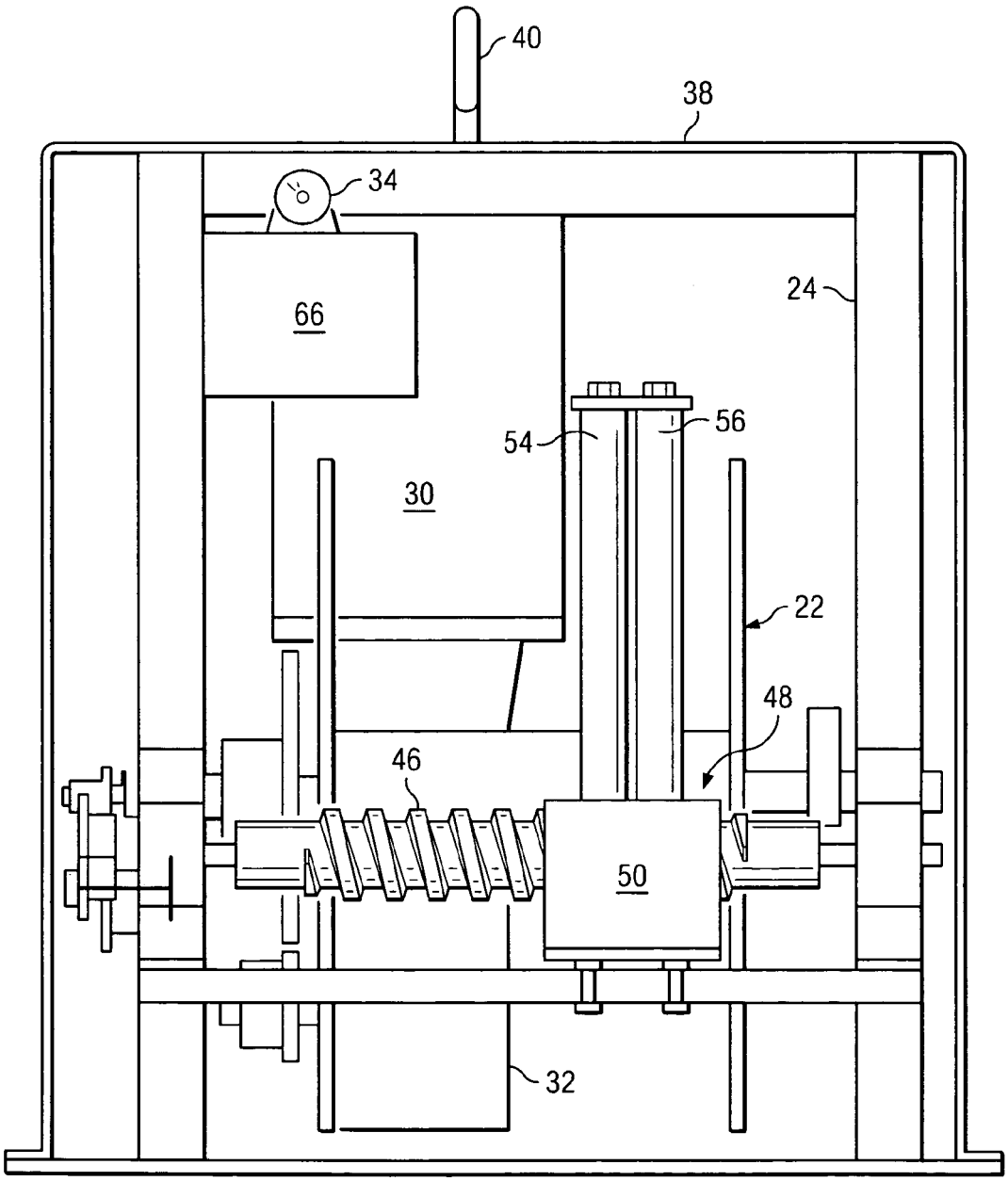
FIG. 2 is the base assembly shown in FIG. 1 from a different view.

The base assembly 14, as shown in FIGS. 1 and 2, generally includes a spool of cable 22 that is mounted on a frame 24, preferably two gear/chain drive assemblies 26, 28, and electric motor/gear box combination 30, 32, an alarm 34, and a hand held control module 36. To protect the base assembly 14, a cover 38 is placed over the base assembly and an eyelet 40 is provided to help lift and move the device, if necessary to another well.

The cable 42 serves two purposes. It is used to lower and raise the sensor assembly 16 into and out of the well 20 and to provide electric current to the sensor assembly 16. Preferably, the cable 42 is a single multi-strand cable coated with a nylon or similar coating, which electrically insulates it. One skilled in the art would appreciate that a variety of gauged cables are available and could be used. The cable needed will depend on power requirements of the interface tool 10 and the weight and/or resistance expected when pulling the sensor from the well. The size of the spool 22 will depend on the length of the cable 42, which should be sufficient enough to allow the sensor assembly 16 to reach the bottom of the well 20. The rotation of the spool of cable 22 is driven by the electric motor/gear box combination 30, 32, which may also be mounted on the frame 24. The gearbox 32 is shown driving the spool 22 using the gear/chain drive assembly 26. Alternatively, the gearbox could be eliminated and the motor could be directly connected to the spool. Eliminating the gearbox would be dependant on the size and weight of the spool. Also, a gas motor could be used instead of the electric motor.

A level wind 44 is provided to help to ensure an even distribution of the cable 42 on the spool 22 as it is rewound. The level wind 44 primarily consists of a worm gear 46 (as seen in FIG. 2) driven by a gear/chain drive assembly 28 connected to the spool 22. As the spool 22 rotates, it rotates the worm gear 46 and drives a cable guide 48, which consists of a follower 50 that has a pin (not shown) that traverses back and forth across grooves of the worm gear 46. Two roll bars 54, 56 extending from the follower 50 and vertically upward as shown to assist the cable 42 to continuously wind evenly on the spool 22. Level winds of the type described are commonly available. One skilled in the art would appreciate that choosing the appropriate level wind would depend on the speed of the rotating spool and size of cable.

Figure 3:
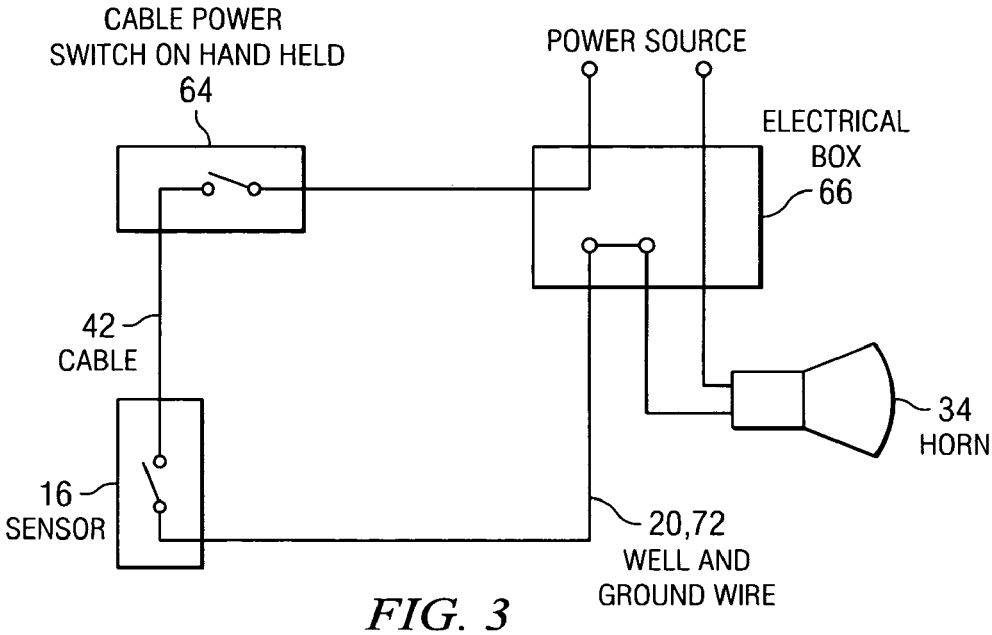
FIG. 3 is a circuit diagram used to illustrate the electrical operation of the apparatus of the present invention.

The interface tool 10 is controlled by the hand held control module 58 and is illustrated as having three switches, 60, 62, and 64. One switch 60 is used to control the main power to the interface tool 10. The second switch 62 controls the up and down direction of the sensor assembly 16 in the well 20 and the third switch is used for turning on and off power to the cable 42. The control module 58 is connected to an outside source of power (not shown) at an electrical box 66, which houses various electrical connections that are described herein. Preferably, wires 68, connecting the hand held module 58 to the interface tool, are long enough to comfortably allow a user to stand next to the interface sensor assembly 12 to monitor the progress of the sensor assembly 16 into and out of the well 20. Generally a circuit is formed by the outside source of power, the cable 42, the sensor assembly 16, and the alarm 34. The alarm 34, which may be a horn, light, buzzer, strobe or siren or other suitable indicator, is used to indicate when either mineralized water or oil is detected. This circuit is illustrated in FIG. 3. Power is delivered to the sensor assembly 16 by electrically connecting the end of the cable 42 wrapped around the axle of the spool 22 to a commonly available armature system with brushes 70 (FIGS. 1 and 2). This armature system is connected to the hot terminal of the external power source. As will be described in more detail below, under certain circumstances, if the sensor assembly 16 detects oil or mineralized water, then the sensor assembly 16 is adapted to close a switch to a circuit including the power supply and alarm. To complete the circuit, the sensor assembly 16 is electrically in contact with the inner casing of the well 20 (as will be discussed in greater detail below) and a ground wire 72 connects the well to the hot terminal of the alarm 34. (Also see FIG. 1). The other terminal of the alarm is connected to the common terminal of the power source. In the present embodiment 24 volts AC is used to power the alarm, but other voltages could be used.

Figure 4:
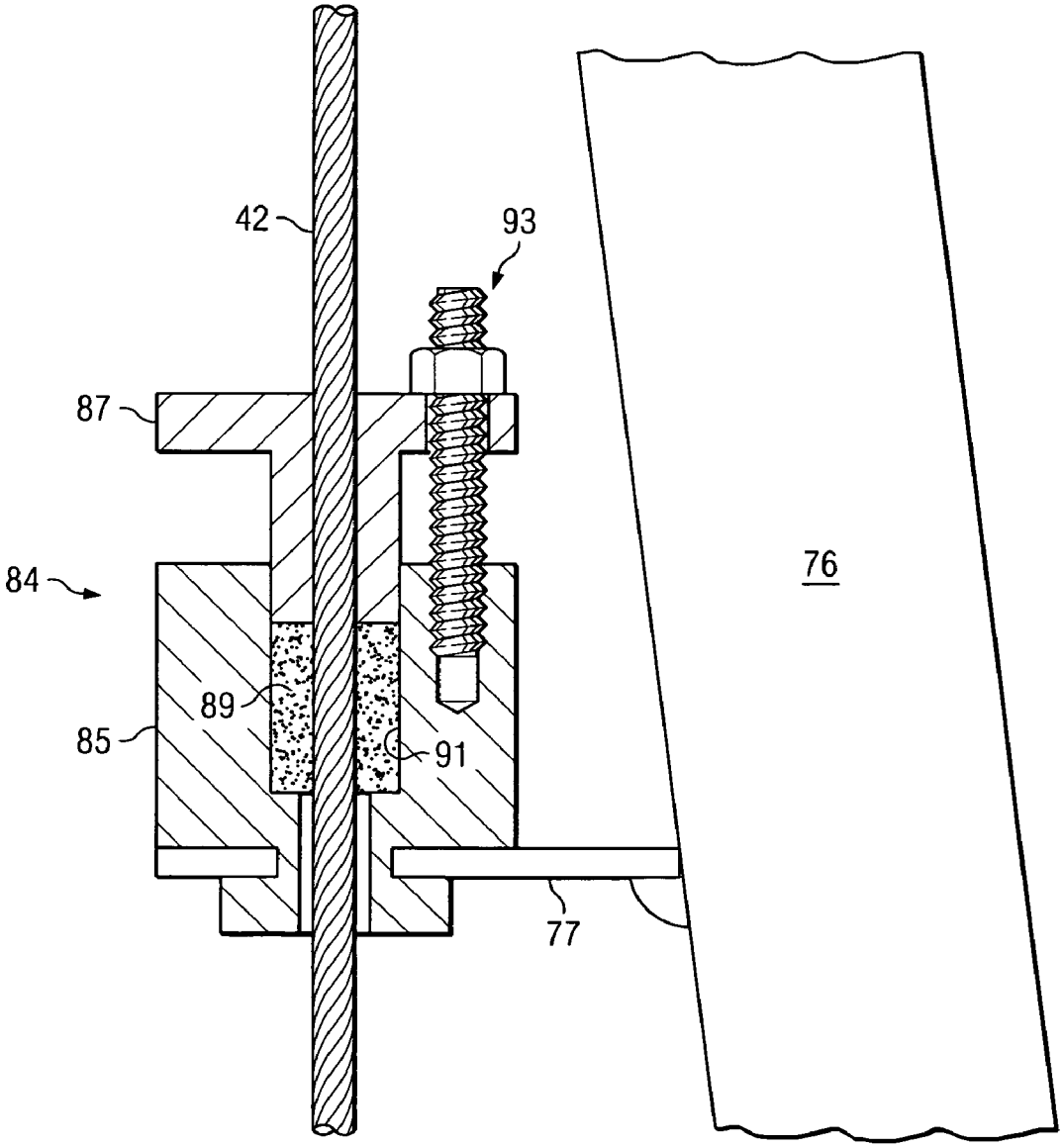
FIG. 4 is an enlarged view of the wiper shown in FIG. 1 for illustrating its components used to wipe the cable clean as it is pulled from the well.

The stand assembly 18 of the interface sensor assembly 12 is placed over and mounted 25 to the well as shown in FIG. 1. The stand assembly 18 is preferably mounted to the top of the well housing using three clamps 74 arranged in a tripod configuration (only one clamp is shown) to secure it to the top of the well. These clamps are preferably made of electrically conductive material. An arm 76 extending over the well 20, as shown, is used to support and assist the sensor assembly 16 into and out of the well 20. Two rollers 78, 80 are mounted on the arm 76 and are used for supporting the cable 42 as shown. A cable counter 82 is also provided to measure the length of cable as it is lowered into the well and identify the depth at which the alarm goes off, indicating oil or mineralized water. Such counters are commonly available and could be mounted to the top roller to count the revolutions that it makes to give an indication of the length of the cable. Since the sensor assembly 16 will be placed in oil, a wiper 84, shown more clearly in FIG. 4, may also be provided to wipe the cable 42 clean from oil before it is rewound onto the spool 22. The wiper 84 is preferably mounted to the arm by a bracket 77 and is comprised of a wiper housing 85 supported by the bracket 77. A cap 87 is used to compress a piece of felt 89 placed in a cavity 91 in the wiper housing 85 and around the cable 42. A nut and bolt assembly 93 could be used to adjust the tension placed on the cable 42.

Figure 5:
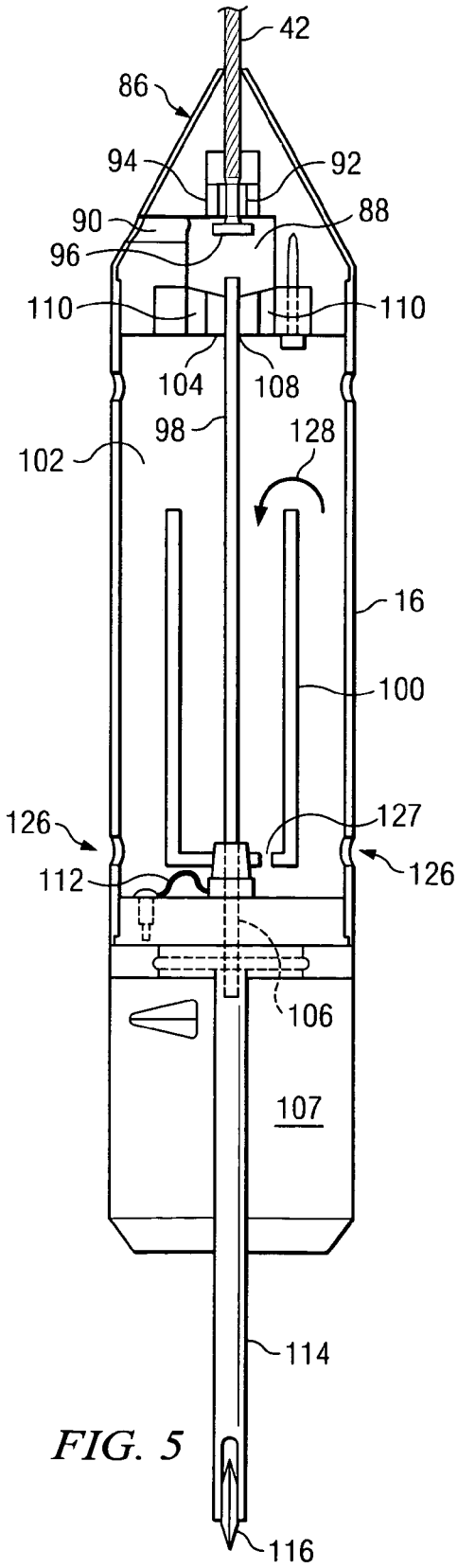
FIG. 5 is a schematic diagram used to illustrate the components of the sensor assembly.

Referring now to FIG. 5, the cable 42 is connected to the interface sensor assembly 16 by allowing it to feed through the top of a nosepiece 86 of the sensor assembly 16 and into an interior cavity 88 formed therein as shown. A port 90 is provided to allow fluid to enter or exit the cavity 88. The cable 42 is preferably attached to the nosepiece 86 by a copper terminal 92 crimped at the end of the cable 42. However, other methods for connecting the cable to the nosepiece could be employed as would be appreciated by one skilled in the art. A plastic insulator 94 is provided to electrically insulate the end of the cable 42 in the cavity from the nosepiece 86. Preferably the nosepiece and the housing are made of electrically conductive non-corrosive material such as stainless steel.

In addition to coupling the sensor assembly 16 to the cable in the manner described above, the end of the cable acts as an electrical contact 96 for a floating ground rod 98. The floating ground rod 98 consists of a metal rod attached to a float 100 that is basically a hollow cup like container that is allowed to freely float in a float chamber 102 of the sensor assembly 16. The float 100 is guided up and down in the float chamber 102 by the ground rod 98, which extends from the bottom of the float upward through a plate 104 attached to the nosepiece 86 and downward through a hole 106 in the base 107 of the sensor assembly 16. The plate 104 has a centering hole 108 sized for allowing the rod 98 to freely slide back and forth as the float 100 rises and falls within the float chamber 102. Other holes 110 are provided in the plate to allow fluid to enter or exit the cavity 88. Similarly the hole 106 in the base is sized to allow the rod 98 to only slide up and down. The floating ground rod 98 is also connected to the base 107 of the sensor assembly 16 by a wire 112 that is allowed to flexibly travel with the float 100 as it rises and falls with the presence of fluid in the float chamber 102.

Figure 6:
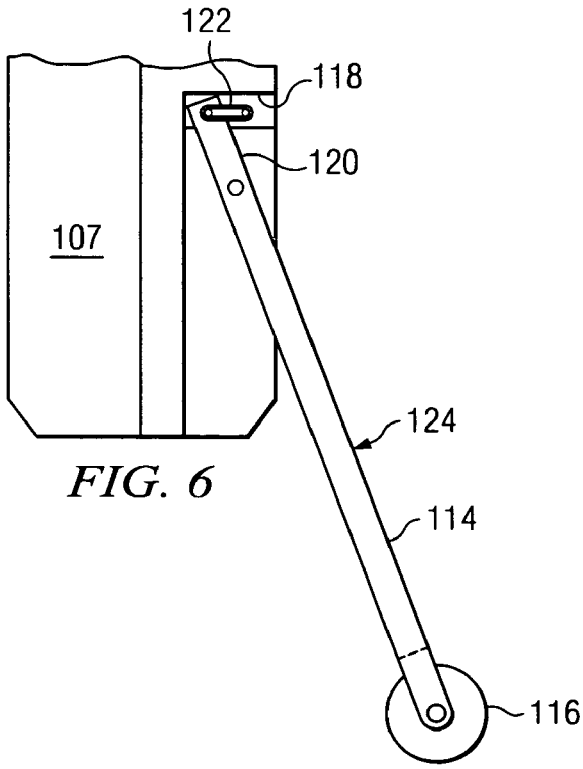
FIG. 6 is a partial schematic diagram of the sensor assembly of FIG. 5 showing one leg being biased by a spring for making electrical contact with the interior wall of a well.

The base 107 of the sensor assembly 16 is equipped with three legs 114 having rollers 116 at the end of the legs as shown. These rollers 114 are preferably biased so as to exert pressure against the interior diameter of the well 20 in order to make electrical contact with the well casing when the sensor assembly 16 is placed down in the well 20. Preferably, the rollers 116 are ground to points, as shown, to help cut through potential build up of material that may have coated the well when oil was pumped from the well in the past or from corrosion formed on the interior diameter of the well casing. One-way of ensuring electrical contact is to spring load the legs 114 so that they push outward and against the interior well housing. As shown in FIG. 6, this can be accomplished by cutting a channel 118 in the base 107 of the sensor housing and mounting the legs 114 (only one is shown) so that a short end of each of the legs is cantilevered in the channel 118. This short end of the leg can be drawn into the channel by wrapping an elastic material such as a spring 122 around the short end of the leg 120 thereby biasing the long end of the leg 114 and hence the roller against the inner wall of the well. It should be understood by those skilled in the art that other techniques could also be employed to accomplish the same function.

The operation of the interface tool 10 will now be described. When the sensor assembly 16 is sent down into the well the power is turned on thereby electrically connecting one side of the potential of the power source to the sensor assembly 16. As the sensor assembly 16 descends into the well 20, the float 100 remains at rest at the bottom of the float chamber 102, keeping the circuit from being completed. Once fluid is encountered in the well 20, it enters the holes 126 in the float chamber 102 thereby filling it. Air in the chamber escapes through the port 90 in the nosepiece 86. As fluid collects in the float chamber 102, the float 100 begins to rise until the ground rod 98 makes contact with the end of the cable 96. When electrical contact is made, the circuit is completed and alarm 34 turns on. As the float chamber 102 continues to fill, fluid pours over into the float 100 (as indicated by arrow 128 of FIG. 5) and it begins to sink, breaking the electrical contact between the rod 98 and the end of the cable 96. Depending on which fluid fills the sensor, the alarm will turn on and then shortly thereafter turn off or it will stay on. If oil fills the float chamber 102 and then the cavity 88, the float 100 will sink and the electrical contact will be broken. As a result the alarm 34 will turn off because oil serves as an insulator breaking the electrical contact between the ground rod 98 and the end of the cable 96. If it is mineralized water filling the cavity 88, the alarm will remain on if the mineralized water is a conductor, as is the case with most mineralized water, such as saltwater that is found in wells. Since oil has less density than mineralized water, it should be appreciated to one skilled in the art that the mineralized water will replace the oil in the cavity and make an electrical contact between the end of the cable and the ground rod. Thus, the user of this device is able to tell whether the sensor assembly 16 is in oil or mineralized water depending on whether the alarm 34 stays on or shortly thereafter goes off. If the alarm 34 is initially activated and then deactivated, that indicates that the sensor is passing through oil. The level of the mineralized water is found by allowing the sensor assembly 16 to continue down the well until the alarm 34 is activated again and remains on. Once float 100 is full, and it is determined to be in oil, the sensor assembly 16 can be pulled up just out of the oil, such that float 100 drains (via aperture 127), then the sensor assembly 100 can be jogged down to determine a more accurate reading of the level of the top of the oil. This allows the user to find such level without bringing the sensor assembly 16 to the surface and dumping the float and then starting the process over. Note, fluid is able to exit float 100 through small aperture 127 located proximate the bottom of the float. Because the volume of fluid exiting at aperture 127 is small in relation to the amount of fluid entering float 100 (as seen at arrow 128), it has minimal effect on the movement of the float 100 based on the fluid only entering the top of the float, yet it allows fluid to drain slowly from float 100 if the float 100 is pulled out of the fluid. In an alternative embodiment, a separate cavity that does not drain through aperture 127 can be incorporated into float 100 such that when sensor assembly 16 is brought to the surface and tipped over, fluid can drain from the port 90 and holes 126. One benefit of the alternative design is that the float 100 retains the mineralized water collected from the well. Dumping it out and visually seeing it verifies the test results for mineralized water.

While the basic components and structure of the interface tool 10 was described in greater detail above, it should be understood by one skilled in the art that several modifications could be made without departing from the sprit and scope of the invention. For example, instead of using a single multi-strand cable to power the sensor assembly, a more expensive two wire multi-strand cable could be used thereby eliminating the need for using the well casing to complete the alarm circuit. Using this approach, one wire would be connected to the electrical contact 96 and the other wire would be connected to the wire 112 connect at the bottom of the floating ground rod 98.

The embodiments shown and described above are only exemplary. Even though numerous characteristics and advantages of the present invention have been set forth in the foregoing description together with details of the method of the invention, the disclosure is illustrative only and changes may be made within the principles of the invention to the full extent indicated by the broad general meaning of the terms used in the attached claims.

What is claimed is:

1. An apparatus for detecting fluids, if they exist, in a well, comprising:

an interface tool comprising an interface sensor assembly and a base assembly;

the interface sensor assembly further comprising a sensor assembly and a sensor stand, the sensor stand adapted to support the sensor assembly and guide the sensor assembly in and out of the well, the sensor assembly adapted to be placed into the well;

the sensor assembly having a fixed, first electrical contact, and a movable float having coupled thereto a second electrical contact in the form of a ground rod the float adapted to rise as fluid surrounds the float causing the ground rod to make physical contact with the first electrical contact when the float floats to a predetermined level;

the base of the sensor assembly being equipped with a plurality of legs, the legs being spring loaded so as to force the legs to push outward and against the inner casing of the well, the legs having electrically conductive rollers at the end of the legs, the rollers being semi-rigidly biased so as to exert pressure against the interior diameter of the inner casing of the well, the rollers being in electrical and physical contact with the inner casing of the well when the sensor assembly is placed down the well, the rollers further being electrically coupled to the ground rod;

a single conductor, multistrand cable mechanically coupling the sensor assembly to the base assembly;

the base assembly further comprising a cable spool, the spool mounted on a frame within the base assembly, the unwinding and winding of the single conductor, multistrand cable from the spool operably lowering and raising, respectively, the sensor assembly into and out of the well, and a cable counter being positioned on an arm coupled to the base assembly and being adapted to measure the length of cable as it is lowered into the well;

a power source having a positive terminal and a negative terminal, the negative terminal coupled to ground;

the single conductor, multistrand cable being wound around the axle of the spool to a commonly available armature system with brushes, the armature system being connected to the positive terminal of the power source; and an alarm switchably, electrically coupled in a circuit formed by the power source, the armature system, the single conductor, multistrand cable, first electrical contact, ground rod, rollers and ground, the alarm adapted to activate when electrical contact is made between the first electrical contact and the ground rod, either through direct physical contact or indirectly via an electrically conductive fluid such as brine.

2. The apparatus of claim 1, further comprising at least one gear/chain drive assembly coupled to an electric motor/gear box combination driving the spool and adapted to wind and unwind the single conductor, multistrand cable.

3. The apparatus of claim 1, further comprising at least one gear/chain drive assembly coupled to a gasoline motor/gear box combination driving the spool and adapted to wind and unwind the single conductor, multistrand cable.

4. The apparatus of claim 1, further comprising a hand held control module adapted to control power from the power source to the sensor assembly and to at least one gear/chain drive assembly coupled to at least one motor/gear box combination driving the spool.

5. The apparatus of claim 4, further comprising the hand held control module having three switches, one switch operable to control the main power to the interface tool, the second switch operable to control the up and down direction of the sensor assembly in the well and the third switch operable for controlling power from the power source to the cable, the control module being coupled to an outside source of power at an electrical box.

6. The apparatus of claim 5, further comprising a cover for covering substantially all of the base assembly and an eyelet coupled to the top of the cover.

7. The apparatus of claim 1, further comprising a level wind being integrated into the base assembly and being adapted to ensure an even distribution of the single conductor, multistrand cable on the spool as it is rewound.

8. The apparatus of claim 7, further comprising the alarm being one selected from the group consisting of a light, horn, buzzer, strobe, and siren.

9. The apparatus of claim 1, further comprising the sensor stand adapted to be placed over and mounted to the well, the sensor stand being mounted to the top of a well housing.

10. An apparatus for detecting fluids, if they exist, in a well, comprising:

an interface tool comprising an interface sensor assembly and a base assembly;

the interface sensor assembly further comprising a sensor assembly and a sensor stand, the sensor stand adapted to support the sensor assembly and guide the sensor assembly in and out of the well, the sensor assembly adapted to be placed into the well;

the sensor assembly having a float and a electrical contact adapted to be in an open state or a closed state, the float adapted to rise as fluid surrounds the float, the float being adapted to close the electrical contact when it floats to a predetermined level;

an alarm electrically coupled to a circuit having a power source, the alarm adapted to activate when the electrical contact is closed;

a cable coupled between the sensor assembly and the base assembly, the cable adapted to electrically couple the power source and alarm to the electrical contact and mechanically couple the base assembly to the sensor assembly;

wherein the base assembly further comprises a spool for the cable, the spool mounted on a frame within the base assembly, the cable being coupled to the sensor assembly and being adapted to lower and raise the sensor into and out of the well and to provide electric current to the sensor assembly;

the sensor stand adapted to be placed over and mounted to the well, the sensor stand being mounted to the to of the well housing;

wherein the sensor stand is mounted to the well using three clamps arranged in a tripod configuration to secure it to the top of the well;

the clamps being comprised of an electrically conductive material;

the sensor stand being coupled to an arm extending over the well adapted to support and assist the sensor assembly into and out of the well;

two rollers being mounted on the arm for supporting the cable;

a cable counter being positioned on the arm and being adapted to measure the length of cable as it is lowered into the well so as to identify the depth at which the alarm activates and deactivates;

a wiper positioned adjacent the counter adapted to wipe the cable clean before it is rewound onto the spool;

the cable being coupled to the sensor assembly by allowing it to feed through the top of a nosepiece of the sensor assembly and into an interior cavity of the sensor assembly;

at least one port being provided into the sensor assembly and being adapted to allow fluid to enter or exit the cavity;

the cable being coupled to the nosepiece by a conductive terminal coupled to the end of the cable;

an insulator being provided at the coupling to the nosepiece to electrically insulate the end of the cable in the cavity from the nosepiece;

the nosepiece and the housing of the sensor assembly being made of electrically conductive non-corrosive material;

the end of the cable in the sensor assembly being adapted to act as an electrical contact for a floating ground rod within the sensor assembly;

the floating ground rod comprising a metal rod attached to a float shaped as a hollow cup that is allowed to freely float in a float chamber of the sensor;

the float being adapted to be guided up and down in the float chamber by the ground rod, the ground rod extending from the bottom of the float upward through a plate attached to the nosepiece and downward through a hole in the base of the sensor assembly;

the plate having a centering hole dimensioned to allow the rod to freely slide back and forth as the float rises and falls within the float chamber;

the hole in the base dimensioned to allow the rod to only slide up and down;

the floating ground rod being coupled to the base of the sensor by a wire adapted to flexibly travel with the float as it rises and falls with the presence of fluid in the float chamber; and the base of the sensor being equipped with a plurality of legs having rollers at the end of the legs, the rollers being biased so as to exert pressure against the interior diameter of the well in order to make electrical contact with the well casing when the sensor is placed down in the well.

11. The apparatus of claim 10, further comprising:

the rollers being ground to points; and the legs being spring loaded so as to force the legs to push outward and against the interior well housing.

* * * * *